US007186954B2

(12) United States Patent
Wilkins

(10) Patent No.: US 7,186,954 B2
(45) Date of Patent: Mar. 6, 2007

(54) APPARATUS FOR DETECTING ABNORMAL TEMPERATURE RISE ASSOCIATED WITH A COOKING ARRANGEMENT

(75) Inventor: Peter Ravenscroft Wilkins, Droitwich (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 11/283,426

(22) Filed: Nov. 18, 2005

(65) Prior Publication Data

US 2006/0118544 A1 Jun. 8, 2006

(30) Foreign Application Priority Data

Dec. 2, 2004 (GB) ..... 0426467.7

(51) Int. Cl.
*H05B 3/68* (2006.01)
*H05B 1/02* (2006.01)

(52) U.S. Cl. ..... 219/448.11; 219/509

(58) Field of Classification Search ..... 219/443–468.2, 219/452, 483, 509, 510, 518
See application file for complete search history.

(56) References Cited

U.S. PATENT DOCUMENTS 4,447,710 A * 5/1984 McWilliams ..... 219/448.14
4,740,664 A * 4/1988 Payne et al. ..... 219/448.12
5,243,172 A 9/1993 Hazan et al.
6,300,606 B1 10/2001 Engelmann et al.
6,350,971 B1 2/2002 Smolenski et al.

FOREIGN PATENT DOCUMENTS

EP 1109424 6/2001

OTHER PUBLICATIONS

International Search Report Apr. 6, 2005.

* cited by examiner

*Primary Examiner*—Sang Y. Paik
(74) *Attorney, Agent, or Firm*—Ira S. Dorman

(57) ABSTRACT

Apparatus is provided for detecting and controlling an abnormal rise in temperature associated with a combination of a cooking utensil (10) and a cooking surface (4) overlying an electric heater (6). A temperature-responsive device (24) monitors the temperature of the cooking utensil (10), while cooking utensil detection means (26) detects the location of the cooking utensil (10). Control means (30) is adapted to control energizing of the heater (6) whereby an abnormal rise in temperature associated with an event within the cooking utensil (10) is distinguished from an abnormal rise in temperature sensed by the temperature-responsive device (24) and associated with removal of the cooking utensil (10) from the cooking surface (4).

15 Claims, 4 Drawing Sheets

APPARATUS FOR DETECTING ABNORMAL TEMPERATURE RISE ASSOCIATED WITH A COOKING ARRANGEMENT

This invention concerns apparatus for detecting an abnormal rise in temperature associated with a combination of a cooking utensil and a cooking surface, such as of glass-ceramic material, overlying an electric heater. Such abnormal rise in temperature may, in particular, result from a boil-dry event within the cooking utensil or an event in the cooking utensil in which a food product adheres to a base of the cooking utensil.

DESCRIPTION OF PRIOR ART

It is known to provide an electric heater arranged at the underside of a cooking surface, such as of glass-ceramic material, and in which the heater incorporates at least one electric heating element spaced from the underside of the cooking surface. A cooking utensil is arranged to be supported on the cooking surface in a cooking zone overlying the heater. It is known to provide a first temperature-responsive device, for example in a cavity between the at least one heating element and the underside of the cooking surface, to monitor temperature within the cavity and of the cooking surface and to operate to de-energise the heater when a maximum permitted temperature is sensed, thereby preventing thermal damage from occurring to the cooking surface. Such first temperature-responsive device may be arranged to provide an electrical output as a function of the temperature sensed and may be arranged to be electrically connected to control means, which may be microprocessor-based circuitry.

It is also known to provide a second temperature-responsive device arranged in contact with, or adjacent to, the underside of the cooking surface within the cooking zone and operating to provide an electrical output to the control means as a function of the temperature of the cooking utensil through the cooking surface within the cooking zone. Such second temperature-responsive device may be used to closely monitor the temperature of the cooking utensil and to provide a closed loop control system in which the heater is appropriately energised to provide a desired heating schedule for the cooking utensil.

When a boil-dry event occurs in the cooking utensil, or a food product being cooked in the cooking utensil adheres to the base thereof, a rise in temperature occurs in the cooking utensil, which although small can be monitored by the second temperature-responsive device and used by the control means to instigate de-energising of the electric heater for safety purposes. Such de-energising will remain effective until a manual reset means is operated by the user.

A problem exists in that if during a cooking cycle the cooking utensil is removed from the cooking surface, even temporarily such as for adding water thereto, the second temperature-responsive device will sense a rise in temperature. This rise in temperature will be seen by the second temperature-responsive device as an abnormal rise in temperature and indistinguishable from that associated with a boil-dry event in the cooking utensil or from that associated with adhesion to the base of the cooking utensil of a food product being cooked. As a result, the heater will be de-energised by the control means and will remain so after the utensil is replaced on the cooking surface, necessitating inconvenient operation of the manual reset means.

A further problem exists in that incorrect location of the cooking utensil on a predetermined cooking zone of the cooking surface overlying the heater and the second temperature-responsive device may result in incorrect sensing of the temperature of the cooking utensil by the second temperature-responsive device.

OBJECT OF THE INVENTION

It is an object of the present invention to overcome or minimise these problems.

SUMMARY OF THE INVENTION

According to the present invention there is provided apparatus for detecting an abnormal rise in temperature associated with a combination of a cooking utensil and a cooking zone of a cooking surface overlying an electric heater and for controlling energising of the heater, the apparatus comprising: a temperature-responsive device adapted to be arranged in contact with or adjacent to an underside of the cooking surface within the cooking zone, for monitoring temperature of the cooking utensil and providing an electrical output as a function thereof; cooking utensil detection means for detecting location of the cooking utensil relative to the cooking surface, the cooking utensil detection means being provided in structural combination with the temperature-responsive device; and control means cooperating with the temperature-responsive device and the cooking utensil detection means and adapted to control energising of the heater from a power supply in dependence upon detection by the detection means of the cooking utensil overlying the temperature-responsive device on the cooking surface, and in dependence upon detection by the temperature-responsive device of an abnormal rise in temperature, whereby an abnormal rise in temperature sensed by the temperature-responsive device associated with an event within the cooking utensil while located on the cooking surface is distinguished from an abnormal rise in temperature sensed by the temperature-responsive device and associated with removal of the cooking utensil from the cooking surface.

The control means may be adapted whereby occurrence of the abnormal rise in temperature associated with the event within the cooking utensil and sensed by the temperature-responsive device, with the cooking utensil located on the cooking surface, results in de-energising of the heater. Such de-energising of the heater may be arranged to be effected until a reset means is operated by a user of the apparatus.

The control means may be adapted to return energisation of the heater to its previous level in the event of removal of the cooking utensil from the cooking surface followed by relocation of the cooking utensil on the cooking surface within a predetermined short time period. Such predetermined short time period may result in an abnormal rise in temperature being sensed by the temperature-responsive device, which abnormal rise in temperature may be included in a temperature range associated with that resulting from the event within the cooking utensil. The short time period may be less than about 5 minutes.

The control means may be adapted not to return energisation of the heater to its previous level in the event of removal of the cooking utensil from the cooking surface followed by relocation of the cooking utensil on the cooking surface in a time period in excess of a predetermined long time period. Energisation of the heater may not be returned to its previous level until a reset means is operated by a user of the apparatus. Such long time period may be in excess of about 5 minutes.

The cooking utensil detection means may comprise an arrangement providing an electrical parameter which changes as a function of location of the cooking utensil relative to the cooking surface and detectable by the control means. Such electrical parameter may comprise electrical inductance or capacitance or an electrical signal resulting from receipt by a receiving means of an optical, infrared, sonic or ultrasonic signal transmitted by a transmitting means and reflected from a base of the cooking utensil.

The cooking utensil detection means may suitably comprise an inductively-operating sensing coil or loop which may be supported on or surrounding at least part of the temperature-responsive device. Such sensing coil or loop may be electrically connected to a resonant circuit arrangement associated with the control means.

The temperature-responsive device may comprise a component whose electrical resistance changes as a function of temperature and may comprise a platinum resistance component. Such component may be provided on a supporting means, such as of ceramic material.

The temperature-responsive device and the cooking utensil detection means may be located in the heater at a peripheral region thereof and such that they underlie a region of the cooking utensil when the cooking utensil is located for heating on the cooking surface.

The control means may comprise microprocessor-based circuitry.

The event within the cooking utensil resulting in the abnormal rise in temperature may be a boil-dry event or an event in which a food product adheres to a base of the cooking utensil.

The cooking surface may comprise glass-ceramic material.

The electric heater may incorporate at least one electric heating element, which may be selected from a radiant electrical resistance heating element and an electrical inductance heating element.

A further temperature-responsive device may be provided, adapted to monitor temperature of the cooking surface, and may be arranged to be electrically connected to the control means.

The further temperature-responsive device may be adapted to monitor temperature of the cooking surface sensed with time.

The further temperature-responsive device may alternatively or additionally be adapted to operate to cause de-energising of the heater when it senses a predetermined maximum permitted temperature of the cooking surface, and/or to operate to provide a predetermined set-point temperature for the cooking surface.

The further temperature-responsive device may comprise a component whose electrical resistance changes as a function of temperature and may comprise a platinum resistance component.

By means of the apparatus of the present invention, a detected rise in temperature resulting from an event within a cooking utensil, such as a boil-dry event or adhesion of a food product to the base of the cooking utensil, is distinguished from a rise in temperature associated with removal of the cooking utensil from the cooking zone of the cooking surface, during a cooking cycle and unnecessary manual re-energising of the heater is avoided when a cooking utensil is temporarily removed. Correct location of a cooking utensil on the cooking surface overlying the temperature-responsive device is also ensured.

For a better understanding of the present invention and to show more clearly how it may be carried into effect, reference will now be made, by way of example, to the accompanying drawings in which:

DESCRIPTION OF PREFERRED EMBODIMENTS

Figure 1:
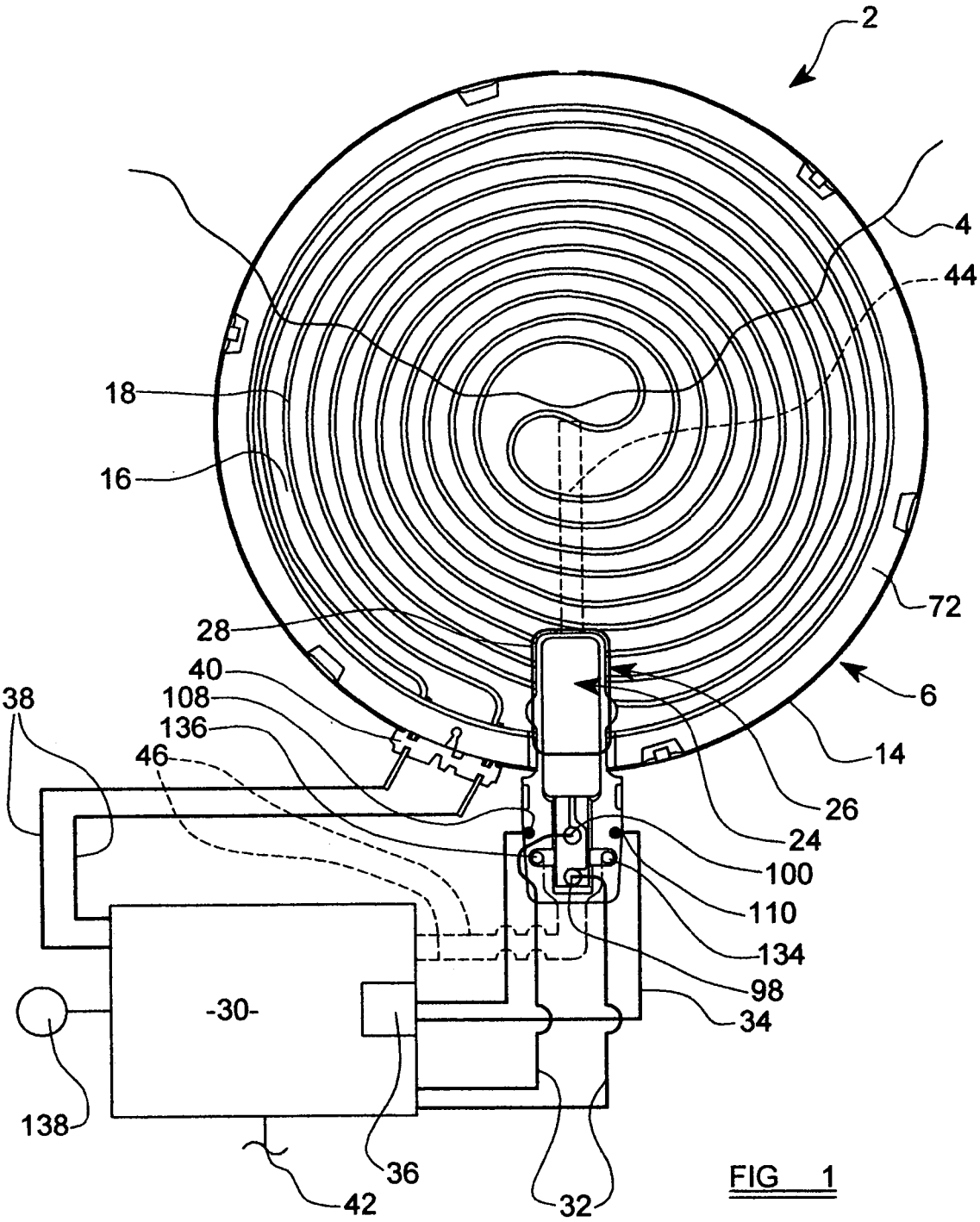
FIG. 1 is a plan view of an embodiment of a cooking arrangement incorporating apparatus according to the present invention for detecting abnormal rise in temperature associated therewith.
Figure 2:
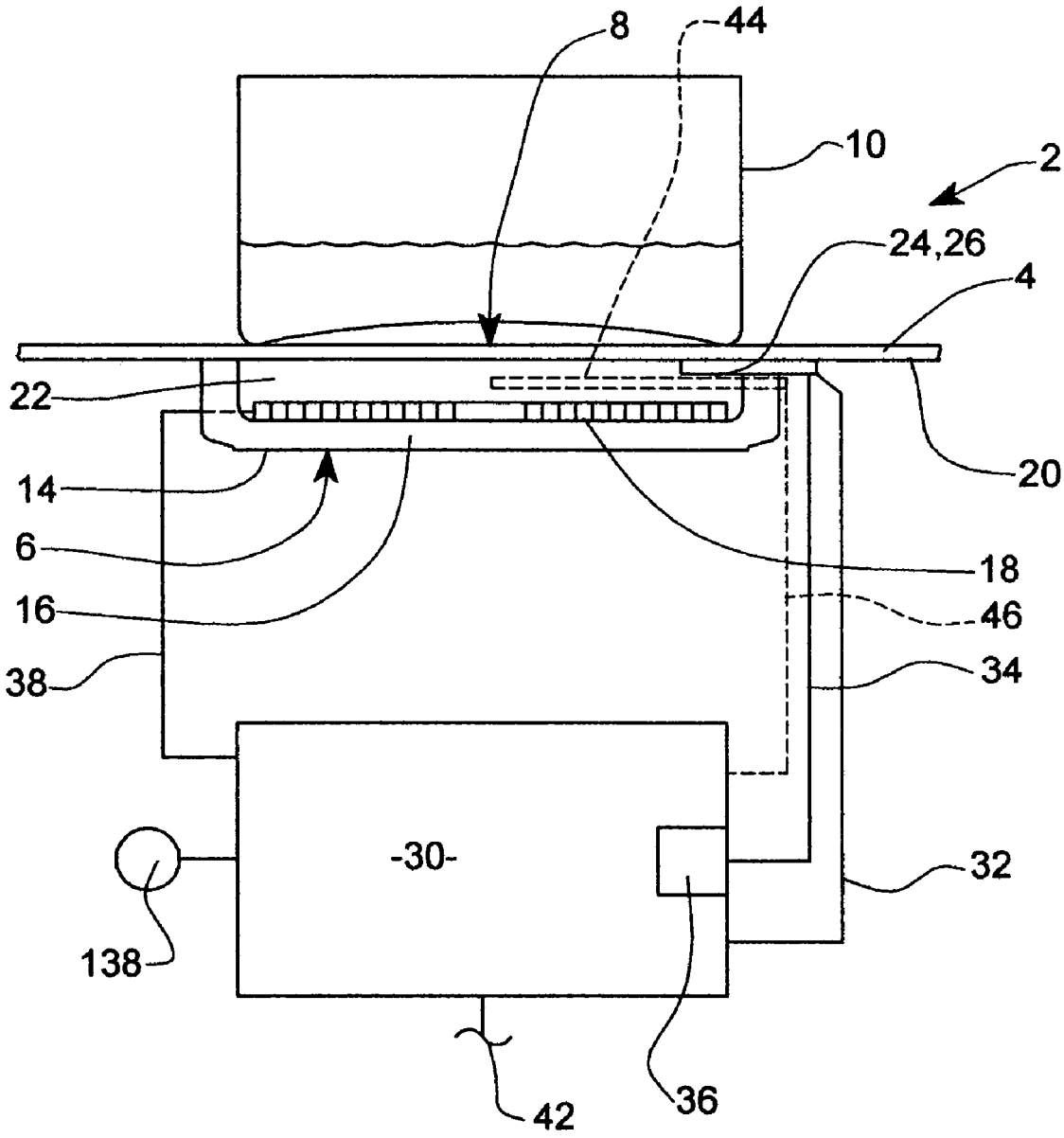
FIG. 2 is a cross-sectional view of the arrangement of FIG. 1.

Referring to FIGS. 1 and 2, a cooking arrangement 2 comprises a cooking surface 4, such as of glass-ceramic material, at an underside of which is supported an electric heater 6. A cooking zone 8 is provided on the cooking surface 4. A cooking utensil 10 containing, for example, water and/or a food product to be heated, is located on the cooking surface 4 at the cooking zone 8.

The heater 6 comprises a dish-like support 14 containing a base layer 16 of thermal insulation material and supporting at least one radiant electrical resistance heating element 18. Instead of the at least one radiant electrical resistance heating element 18, at least one electrical induction heating element of known form could be provided. The at least one heating element 18 is spaced from the underside 20 of the cooking surface 4, such that a cavity 22 is formed.

A temperature-responsive device 24 is provided, located in contact with, or adjacent to, the underside 20 of the cooking surface 4, within the cooking zone 8 and is adapted to provide an electrical output as a function of temperature of the cooking utensil 10 through the cooking surface 4 within the cooking zone 8 at a peripheral region thereof. As will be described in detail hereinafter, the temperature-responsive device 24 suitably comprises a component, such as a platinum resistance component, whose electrical resistance changes as a function of temperature.

A cooking utensil detection means 26 is provided in structural combination with the temperature-responsive device 24. The cooking utensil detection means 26 comprises an arrangement providing an electrical parameter which changes as a function of location of the cooking utensil 10 relative to the cooking surface 4. In particular, the electrical parameter comprises electrical inductance, with the cooking utensil detection means 26 comprising an inductively-operating sensing coil or loop 28 supported on or surrounding at least part of the temperature-responsive device 24 and consisting of one or more turns of electrically conductive material, such as in the form of wire or ribbon.

Other forms of cooking utensil detection means 26 could alternatively be provided. For example an arrangement could be employed which provides a change of electrical capacitance as a function of location of the cooking utensil 10 relative to the cooking surface 4. Other arrangements may be employed which provide an electrical signal resulting from receipt by a receiving means of an optical, infrared, sonic or ultrasonic signal transmitted by a transmitting means towards a base of the cooking utensil 10 and reflected from the base of the cooking utensil 10.

The cooking utensil detection means 26 need not necessarily be provided in structural combination with the temperature-responsive device 24.

A microprocessor-based control means 30, containing processing and control circuitry and operating with appropriate software algorithms, is electrically connected to the temperature-responsive device 24 by leads 32 and to the cooking vessel detection means 26 by leads 34. An appropriate resonant circuit arrangement 36 of known form is suitably provided, operating in association with the control means 30 for processing signals from the inductively-operating sensing coil or loop 28 of the cooking utensil detection means 26.

The control means 30 is also electrically connected by leads 38 to the at least one heating element 18, by way of a terminal block 40 provided at an edge of the heater 6, and is arranged to control energising of the at least one heating element 18 from a power supply 42.

The temperature-responsive device 24 is adapted to measure small increases in temperature of the cooking utensil 10 through the cooking surface 4 resulting, for example, from a boil-dry event occurring within the cooking utensil 10 or an event in which a food product adheres to a base of the cooking utensil 10 during a cooking cycle.

A further temperature-responsive device 44 may be provided, extending across the heater 6 in the cavity 22 and electrically connected to the control means 30 by means of leads 46. Such further temperature-responsive device 44 may extend beneath and/or be combined with and/or secured in common with the temperature-responsive device 24. The further temperature-responsive device 44 is adapted to monitor temperature of the cooking surface 4 and may monitor temperature sensed with time. Alternatively or additionally, the further temperature-responsive device 44 may be adapted to operate to cause de-energising of the heater 6 when it senses a predetermined maximum permitted temperature of the cooking surface 4, and/or to operate to provide a predetermined set-point temperature for the cooking surface 4.

The further temperature-responsive device 44 may comprise a component, such as a platinum resistance component, whose electrical resistance changes as a function of temperature.

Figure 3A:
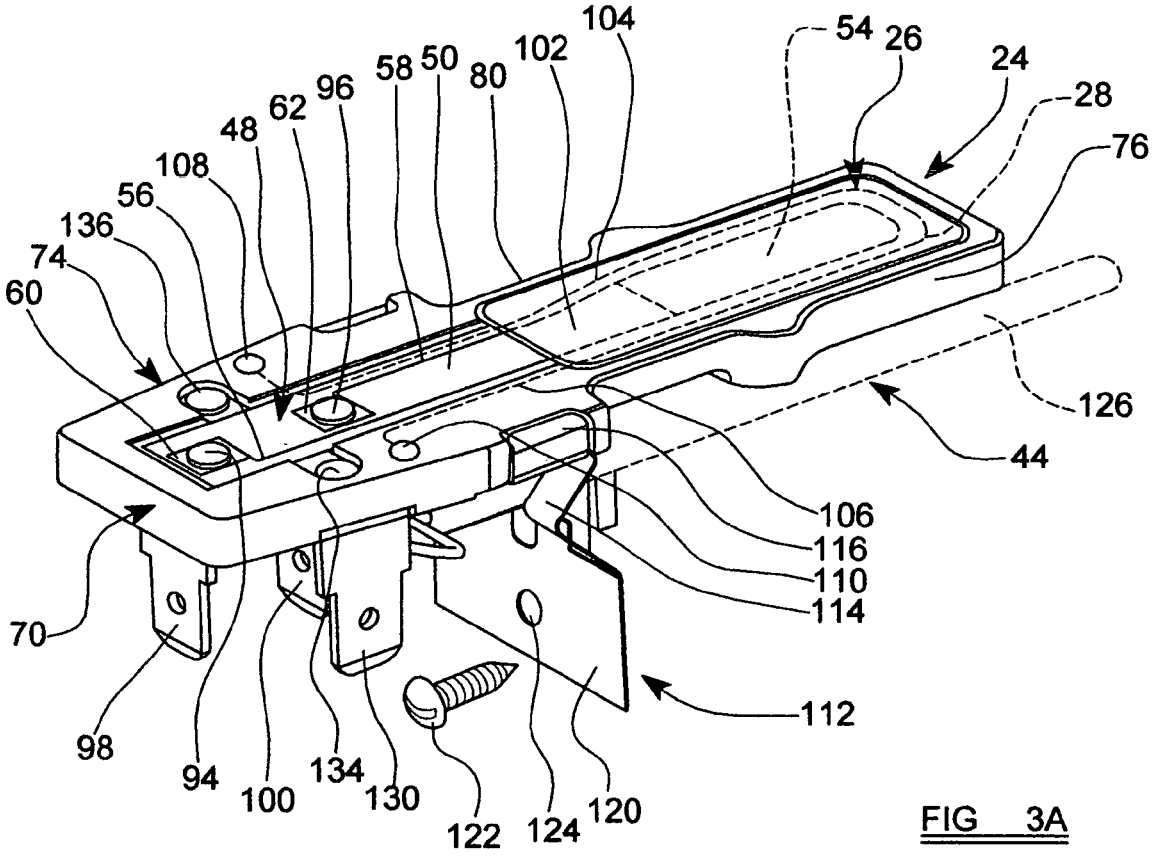
FIG. 3A is a perspective view of an embodiment of a temperature-responsive device in combination with an embodiment of a cooking utensil detection means, for use in the arrangement of FIGS. 1 and 2.
Figure 3B:
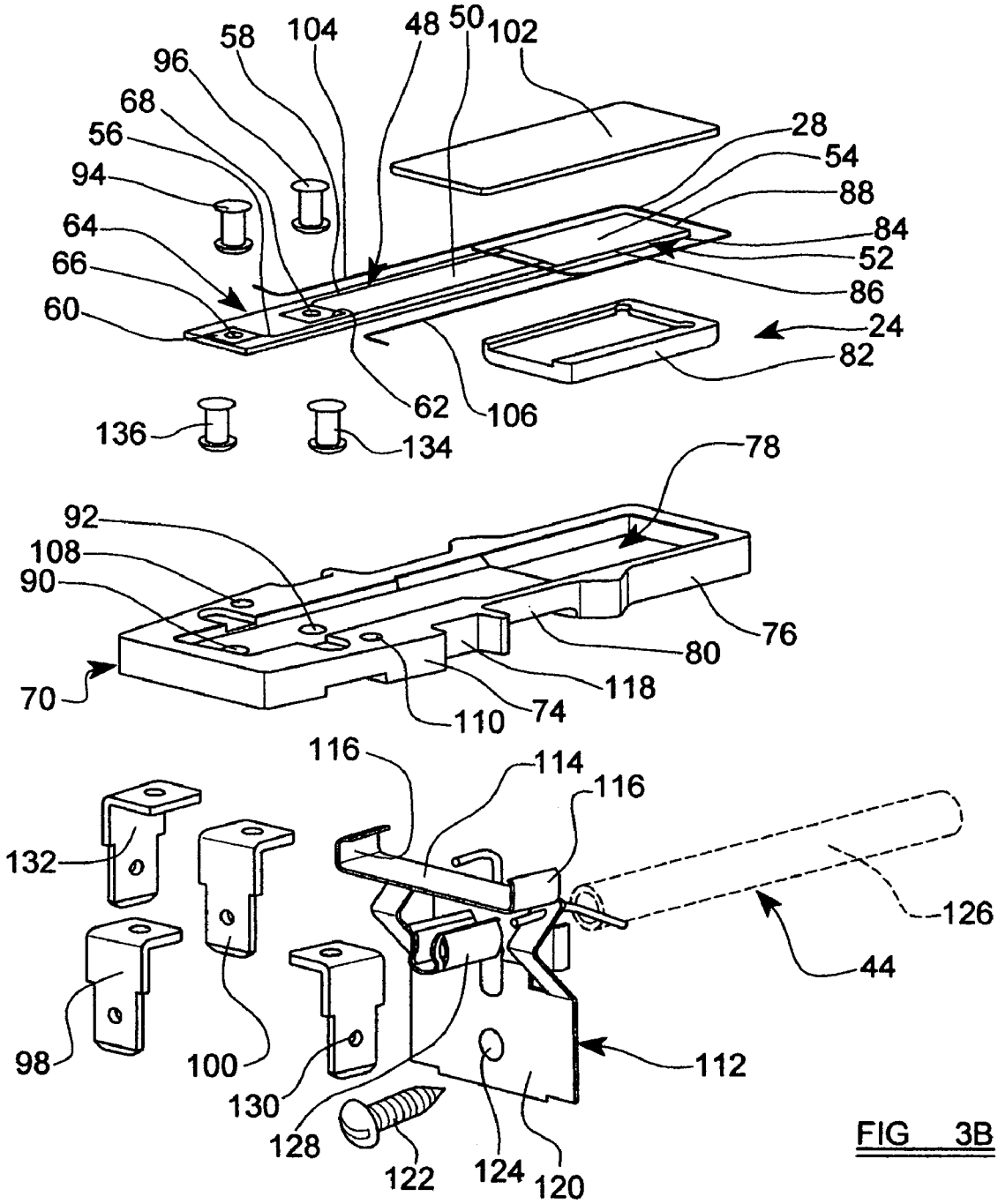
FIG. 3B is an exploded view of the device of FIG. 3A.

The construction of the temperature-responsive device 24 in combination with the cooking utensil detection means 26 is shown in detail in FIGS. 3A and 3B.

Referring to FIGS. 3A and 3B, the temperature-responsive device 24 comprises a substantially planar thin elongate substrate 48, such as of ceramic or other electrically insulating material, having an upper surface 50 provided at a first end region 52 thereof with a temperature-sensitive electrical resistance element 54 of film form and suitably comprising platinum. The resistance element 54 may be deposited onto the surface 50 of the substrate 48 by a thick film printing technique, although other deposition techniques may be applied. The ceramic substrate 48 suitably has a thickness of from about 0.5 to 1 mm and suitably comprises alumina. A suitable electrical resistance value for the temperature-sensitive electrical resistance element 54 is from about 50 to about 1000 ohms at 0 degrees Celsius and preferably from about 100 to about 500 ohms.

Electrical connecting leads 56, 58, also of film form, are provided on the upper surface 50 of the substrate 48 and are electrically connected to the temperature-sensitive electrical resistance element 54. The electrical connecting leads 56, 58 suitably comprise the same or similar material as the electrical resistance element 54 and extend to terminal pads 60, 62 provided at a second end region 64 of the substrate 48. The terminal pads 60, 62 may comprise substantially the same or a similar material as the electrical connecting leads 56, 58 or may comprise a different material, such as gold. Holes 66, 68 are provided through the pads 60, 62 and through the substrate 48.

An elongate support member 70, arranged as a beam, is adapted to extend at least partly across the heater 6 from a peripheral region of the heater, across an aperture or recess in a peripheral wall 72 and a rim of the dish-like support 14, with a first end 74 of the support member 70 secured externally of the heater at the peripheral region of the heater and with a second end 76 thereof located within the heater. The support member 70 suitably comprises a ceramic material, such as steatite, cordierite or alumina, and is provided with an elongate recess 78 into which is received the substrate 48. The temperature-sensitive electrical resistance element 54 is located at or near the second end 76 of the support member 70 within the heater 6 at a peripheral region thereof, and the terminal pads 60, 62 are located externally of the heater, at the first end 74 of the support member 70, where they are subjected to a relatively low temperature.

The support member 70 is shaped in such a way as to provide waist-like regions 80 which locate the support member 70 where it crosses the aperture or recess in the peripheral wall 72 of the heater 6.

Thermal insulation means 82 is provided in the recess 78 in the support member 70, interposed between the support member 70 and a lower surface 84 and side edges 86, 88 of the substrate 54. The thermal insulation means 82 preferably comprises a thin layer of microporous thermal insulation material, suitably of a thickness from 1 to 4 mm and preferably from 2 to 3 mm. Alternatively or additionally, the thermal insulation material 82 could comprise granular thermal insulation material, such as vermiculite or calcium silicate.

The substrate 48 and thermal insulation means 82 may be press-moulded into the recess 78 in the support member 70.

Holes 90, 92 are provided through the support member 70 at the first end 74 thereof. The holes 90, 92 are aligned with the holes 66, 68 in the ceramic substrate 48 and are arranged to receive electrically connecting members 94, 96, suitably comprising bolts, pins or rivets, for electrically connecting the terminal pads 60, 62 to terminal tabs or pins 98, 100 and for mechanically securing the ceramic substrate 48 to the support member 70. The terminal tabs or pins 98, 100 are arranged for electrically connecting the temperature-sensitive electrical resistance element 54 to the control means 30 by means of the leads 32. When the electrically connecting members 94, 96 comprise bolts, such bolts suitably comprise brass, plated with silver or nickel. When the electrically connecting members 94, 96 comprise rivets, such rivets suitably comprise copper, plated with gold.

A thermally conducting, electrically insulating member 102, in the form of a substantially planar tile or thin beam, may be provided, arranged to overlie and contact the temperature-sensitive electrical resistance element 54 and its electrically connecting leads 56, 58 at least at a region within the confines of the heater 6. The electrically insulating member comprises a suitable ceramic material and serves to electrically insulate the temperature-sensitive electrical resistance element 54 and the connecting leads 56, 58 from the cooking surface 4, which exhibits significant electrical conductivity when hot. The electrically insulating member 102 is suitably recessed into the support member 70 such that it provides an upper surface substantially coplanar with that of the support member 70.

The cooking utensil detection means 26 has its inductively-operating sensing coil or loop 28 of wire or ribbon form supported on or surrounding at least part of the second end 76 of the supporting member 70 and such that it substantially surrounds the region of the temperature-sensitive electrical resistance element 54. The sensing coil or loop 28 is provided with opposite end regions 104, 106, which are electrically connected to terminals 108, 110 at the first end 74 of the support member 70. The sensing coil or loop 28 is electrically connected to the resonant circuit arrangement 36 in the control means 30 by means of the leads 34, the leads 34 being connected to the terminals 108, 110 at the first end 74 of the support member 70.

A metal mounting bracket 112 is provided for the temperature-responsive device 24. The mounting bracket 112 suitably comprises stainless steel and has a first portion 114 arranged with clip means 116 securely engaging portions 118 of the first end 74 of the support member 70. The engaging portions 118 are suitably provided as recesses or rebates in the support member 70. The mounting bracket 112 has a second portion 120 arranged to be secured to the rim of the dish-like support 14 of the heater 6 by means of a threaded fastener 122 passing through a hole 124 in the second portion 120 of the mounting bracket 112. The mounting bracket 112 is suitably provided of cantilevered form from a single bent sheet or strip of metal and such that the second end 76 of the support member 70 is spring-biased towards the underside 20 of the cooking plate 4. In this way, the upper surface of the temperature-responsive device 24 can be maintained substantially in contact and good thermo-conducting relationship with the underside 20 of the cooking plate 4. The mounting bracket 112 may be constructed to incorporate alternative spring-loading means.

The mounting bracket 112 may be adapted to support the further temperature-responsive device 44, which may have a rod-like or beam-like sensing portion 126 adapted to be secured to the mounting bracket 112 by clip means 128 provided on the bracket and arranged to extend beneath the support member 70 at least partly across the heater 6 from a peripheral region of the heater. The further temperature-responsive device 44 is arranged to be electrically connected to and to cooperate with the control means 30 by way of the connecting leads 46, terminal tabs or pins 130, 132 and electrically connecting members 134, 136.

The temperature-responsive device 24 operates in association with the control means 30 to monitor the temperature of the cooking utensil 10 through the cooking surface 4. The temperature-sensitive electrical resistance element 54 is shielded from the effect of direct thermal radiation from the heating element or elements 18 in the heater 6 by the thermal insulation means 82. A region of the cooking surface 4 immediately overlying the temperature-responsive device 24 is also shielded from the direct thermal radiation from the heating element or elements 18 and heat from the cooking utensil 10 is conducted into this region. Small changes in temperature of the cooking utensil 10 are able to be monitored by the temperature-responsive device 24 and its associated control means 30, during a cooking cycle. Such small changes may be abnormal small changes, in particular resulting from a boil-dry event occurring within the cooking utensil 10 or from an event in the cooking utensil 10 in which a food product adheres to the base of the cooking utensil 10. When a small change in temperature of this nature is detected, the control means 30 operates to de-energise, or to reduce the energisation level of, the heater 6 as a safety measure. The heater 6 is then arranged to remain de-energised, or at a lower energisation level, until a reset means 138, associated with the control means 30, is manually reset by a user of the cooking arrangement. Such a reset means 138 may, for example, be operated by a suitable button.

It is important for correct operation of the cooking arrangement 2 that the cooking utensil 10 properly overlies the temperature-responsive device 24 on the cooking surface 4, regardless of the size of the cooking utensil 10. It is particularly important to ensure correct operation of the cooking arrangement when a small cooking utensil 10 is provided and which may be smaller than the cooking zone 8. Here there is a risk that such a small cooking utensil may be located on the cooking zone 8 of the cooking surface 4 offset from the region under which the temperature-responsive device 24 is provided. In such a situation, false monitoring of temperature of the cooking utensil 10 by the temperature-responsive device 24 results. This situation is avoided in the present invention. The cooking utensil detection means 26, operating with its associated circuit 36 in the control means 30, senses placement of the cooking utensil 10 on the cooking surface 4 and functions to enable energising of the heater 6 only when the cooking utensil 10 is properly located on the cooking surface 4 overlying the temperature-responsive device 24.

The cooking utensil detection means 26 further operates as follows. If during a cooking cycle the cooking utensil 10 is removed from the cooking surface 4 by a user for a short time period, for example in order to add further contents such as additional water to the cooking utensil 10, a rise in temperature occurs in the region of the cooking surface 4 overlying the temperature-responsive device 24. Hitherto this would be interpreted by the temperature-responsive device 24 and the associated control means 30 as if it were an undesirable abnormal rise in temperature within the cooking utensil 10, resulting in de-energising or the like of the heater 6. Operation of the manual reset means 138 by the user would then be required for re-energising of the heater 6 after replacement of the cooking utensil 10 on the cooking surface 4 at the end of the short time period. This inconvenience is overcome in the present invention in that if the cooking utensil 10 is removed from the cooking surface 4 for a predetermined short time period, for example less than 5 minutes, such removal is detected by the cooking utensil detection means 26 in association with the control means 30 and the heater 6 is de-energised or the like by the control means 30. When the cooking utensil 10 is properly relocated on the cooking surface 4 before the end of the predetermined short time period, this is detected by the cooking utensil detection means 26 and the associated control means 30 operates to automatically re-energise the heater 6. Such re-energising is effected even if the abnormal rise in temperature resulting from the activity is included in a temperature range associated by the control means 30 with that resulting from a boil-dry event within the cooking utensil 10 or from an event within the cooking utensil 10 in which a food product adheres to the base of the cooking utensil 10.

If the cooking utensil 10 is removed from the cooking surface 4 for a predetermined long time period, for example more than 5 minutes, this is detected by the cooking utensil detection means 26, in association with the control means 30 and the heater 6 is de-energised or the like by the control means. However, in this case, because such a predetermined long time period has been detected, when the cooking utensil 10 is relocated on the cooking surface 4 at the end of the long time period the heater 6 is arranged to remain de-energised or the like until the reset means 138 is operated by the user.

I claim:

1. Apparatus for detecting an abnormal rise in temperature associated with a combination of a cooking utensil and a cooking zone of a cooking surface overlying an electric heater and for controlling energising of the heater, the apparatus comprising: a temperature-responsive device comprising a component whose electrical resistance changes as a function of temperature provided on a supporting means and adapted to be arranged in contact with or adjacent to an underside of the cooking surface within the cooking zone, for monitoring temperature of the cooking utensil and providing an electrical output as a function thereof; cooking utensil detection means for detecting location of the cooking utensil relative to the cooking surface, the cooking utensil detection means comprising an inductive sensor supported on at least part of the temperature-responsive device and surrounding the electrical resistance component; and control means cooperating with the temperature-responsive device and the cooking utensil detection means and adapted to control energising of the heater from a power supply in dependence upon detection by the detection means of the cooking utensil overlying the temperature-responsive device on the cooking surface, and in dependence upon detection by the temperature-responsive device of an abnormal rise in temperature, whereby an abnormal rise in temperature sensed by the temperature-responsive device associated with an event within the cooking utensil while located on the cooking surface is distinguished from an abnormal rise in temperature sensed by the temperature-responsive device and associated with removal of the cooking utensil from the cooking surface.

2. Apparatus as claimed in claim 1, wherein the control; means is adapted whereby occurrence of the abnormal rise in temperature associated with the event within the cooking utensil and sensed by the temperature-responsive device, with the cooking utensil located on the cooking surface, results in de-energising of the heater.

3. Apparatus as claimed in claim 2, wherein the de-energising of the heater is arranged to be effected until a reset means is operated by a user of the apparatus.

4. Apparatus as claimed in claim 1, wherein the control means is adapted to return energisation of the heater to its previous level in the event of removal of the cooking utensil from the cooking surface followed by relocation of the cooking utensil on the cooking surface within a predetermined short time period.

5. Apparatus as claimed in claim 4, wherein the predetermined short time period results in an abnormal rise in temperature being sensed by the temperature-responsive device.

6. Apparatus as claimed in claim 5, wherein the abnormal rise in temperature is included in a temperature range associated with that resulting from the event within the cooking utensil.

7. Apparatus as claimed in claim 4, wherein the short time period is less than about 5 minutes.

8. Apparatus as claimed in claim 1, wherein the control means is adapted not to return energisation of the heater to its previous level in the event of removal of the cooking utensil from the cooking surface followed by relocation of the cooking utensil on the cooking surface in a time period in excess of a predetermined long time period.

9. Apparatus as claimed in claim 8, wherein energisation of the heater is not returned to its previous level until a reset means is operated by a user of the apparatus.

10. Apparatus as claimed in claim 8, wherein the long time period is in excess of about 5 minutes.

11. Apparatus as claimed in claim 1, wherein the inductive sensor is selected from an inductively-operating sensing coil and an inductively-operating sensing loop.

12. Apparatus as claimed in claim 1, wherein the cooking utensil detection means is electrically connected to a resonant circuit arrangement associated with the control means.

13. Apparatus as claimed in claim 1, wherein the temperature-responsive device and the cooking utensil detection means are located in the heater at a peripheral region thereof and such that they underlie a region of the cooking utensil when the cooking utensil is located for heating on the cooking surface.

14. Apparatus as claimed in claim 1, wherein the event within the cooking utensil resulting in the abnormal rise in temperature is selected from a boil-dry event and an event in which a food product adheres to a base of the cooking utensil.

15. Apparatus as claimed in claim 1, wherein a further temperature-responsive device is provided, adapted to monitor temperature of the cooking surface.

* * * * *